US007178705B1

(12) United States Patent
Sutton

(10) Patent No.: US 7,178,705 B1
(45) Date of Patent: Feb. 20, 2007

(54) GARMENT HANGER HAVING HOOK PROVIDED WITH LOCKING INDICATOR

(75) Inventor: Steven Sutton, Brooklyn, NY (US)

(73) Assignee: The Accessory Coporation, New York, NY (US)

( * ) Notice: Subject to any disclaimer, the term of this patent is extended or adjusted under 35 U.S.C. 154(b) by 296 days.

(21) Appl. No.: 10/852,246

(22) Filed: May 24, 2004

(51) Int. Cl.
*A41D 27/22* (2006.01)

(52) U.S. Cl. ..... 223/85

(58) Field of Classification Search ..... 223/85, 223/92, 95, 97, DIG. 1; 40/322; D6/315
See application file for complete search history.

(56) References Cited

U.S. PATENT DOCUMENTS

| | | | | |
|---|---|---|---|---|
| 3,898,754 | A | 8/1975 | Johansson | 40/322 |
| 4,045,899 | A | 9/1977 | Richardson | 40/322 |
| 4,137,661 | A | 2/1979 | Johansson | 40/322 |
| 4,198,773 | A | 4/1980 | Batts et al. | 40/322 |
| 4,322,902 | A | 4/1982 | Lenthall | 40/322 |
| 4,450,639 | A | 5/1984 | Duester | 40/322 |
| 4,881,836 | A | 11/1989 | Blanchard | 40/322 |
| 4,886,195 | A | 12/1989 | Blanchard | 223/85 |
| 4,997,114 | A | 3/1991 | Petrou | 223/85 |
| 5,096,101 | A | 3/1992 | Norman et al. | 223/85 |
| 5,135,141 | A | 8/1992 | Harmer et al. | 223/85 |
| 5,238,159 | A | 8/1993 | Zuckerman | 223/85 |
| 5,305,933 | A | 4/1994 | Zuckerman | 223/85 |
| 5,377,884 | A | 1/1995 | Zuckerman | 223/85 |
| 5,383,583 | A | 1/1995 | Zuckerman | 223/85 |
| 5,388,354 | A | 2/1995 | Marshall et al. | 40/322 |
| 5,407,109 | A | 4/1995 | Zuckerman | 223/85 |
| 5,441,182 | A | 8/1995 | Sullivan | 223/85 |
| 5,449,099 | A | 9/1995 | Blanchard | 223/85 |
| 5,469,995 | A | 11/1995 | Bredeweg et al. | 223/85 |
| 5,477,995 | A | 12/1995 | Dooley et al. | 223/85 |
| 5,485,943 | A | 1/1996 | Zuckerman | 223/85 |
| 5,503,310 | A | 4/1996 | Zuckerman et al. | 223/85 |
| 5,524,801 | A | 6/1996 | Dooley et al. | 223/85 |
| 5,586,697 | A | 12/1996 | Johansson | 223/85 |
| 5,590,822 | A | 1/1997 | Zuckerman | 223/85 |
| 5,597,100 | A | 1/1997 | Blitz | 223/85 |
| 5,603,437 | A | 2/1997 | Zuckerman | 223/85 |
| 5,611,469 | A | 3/1997 | Eiley et al. | 223/85 |
| 5,613,629 | A | 3/1997 | Zuckerman | 223/85 |
| 5,628,132 | A | 5/1997 | Marshall et al. | 40/322 |
| 5,641,100 | A | 6/1997 | Mitchell et al. | 223/85 |
| 5,642,840 | A | 7/1997 | Abdi | 223/85 |
| 5,683,018 | A | 11/1997 | Sullivan et al. | 223/85 |
| 5,687,887 | A | 11/1997 | Bond et al. | 223/85 |
| 5,775,553 | A | 7/1998 | Marshall et al. | 223/85 |

(Continued)

*Primary Examiner*—Gary L. Welch
(74) *Attorney, Agent, or Firm*—Gordon & Jacobson, PC

(57) ABSTRACT

A garment hanger includes a hook defining a web having an upper free end which receives an indicator and laterally displaced engagement elements which engage an indicator. A ridge is provided at the bottom of the web to prevent finger purchase on the lower end of the indicator. In addition, at least lower portions of the sides of the web are also provided with ridges to prevent finger purchase. The indicator includes two parallel and substantially planar sides, a closed top, open ends, and an open bottom. The sides include inwardly extending mating elements which are adapted to engage with the laterally displaced engagement elements on the web. The web and indicator together provide an effective assembly for garment identification, and can be securely coupled together in a manner which is substantially permanent.

23 Claims, 3 Drawing Sheets

U.S. PATENT DOCUMENTS

| | | | | |
|---|---|---|---|---|
| 5,778,575 | A | 7/1998 | Deupree et al. | 40/322 |
| 5,785,216 | A | 7/1998 | Gouldson et al. | 223/85 |
| 5,819,995 | A | 10/1998 | Zuckerman | 223/85 |
| 5,857,276 | A | 1/1999 | Marshall et al. | 40/322 |
| 5,884,422 | A | 3/1999 | Marshall et al. | 40/322 |
| 5,913,462 | A | 6/1999 | Petrou | 223/85 |
| 5,944,237 | A | 8/1999 | Gouldson | 223/85 |
| 5,950,883 | A | 9/1999 | Bond et al. | 223/85 |
| 6,019,260 | A | 2/2000 | Gouldson | 223/85 |
| 6,041,983 | A | 3/2000 | Sullivan et al. | 223/85 |
| 6,145,713 | A | 11/2000 | Zuckerman | 223/85 |
| 6,189,746 | B1 | 2/2001 | Gouldson | 223/85 |
| 6,209,241 | B1 | 4/2001 | Louw | 40/322 |
| 6,260,745 | B1 | 7/2001 | Gouldson et al. | 223/85 |
| 6,264,075 | B1 | 7/2001 | Gouldson et al. | 223/85 |
| 6,378,744 | B2 | 4/2002 | Olk et al. | 223/85 |
| 6,382,478 | B2 | 5/2002 | Gouldson et al. | 223/85 |
| 6,422,437 | B2 | 7/2002 | Gouldson et al. | 223/85 |
| 6,499,633 | B1 | 12/2002 | Pogmore | 223/85 |
| 6,499,634 | B2 | 12/2002 | Olk et al. | 223/85 |
| 6,564,980 | B2 | 5/2003 | Gouldson et al. | 223/85 |
| 6,622,897 | B2 | 9/2003 | Bokmiller et al. | 223/93 |
| 6,681,966 | B2 | 1/2004 | Gouldson et al. | 223/85 |
| 6,705,496 | B2 | 3/2004 | Marshall et al. | 223/85 |
| 6,726,067 | B2 | 4/2004 | Louw | 223/85 |
| 6,932,251 | B2 * | 8/2005 | Kolton et al. | 223/85 |

* cited by examiner

GARMENT HANGER HAVING HOOK PROVIDED WITH LOCKING INDICATOR

BACKGROUND OF THE INVENTION

1. Field of the Invention

This invention relates broadly to garment hangers. More particularly, this invention relates to a system of a garment hanger having a hook with an upper web and an indicator which locks relative thereto, the indicator providing information with respect to the garment supported by the hanger, as well as to the individual garment hanger and the indicator.

2. State of the Art

Garment hangers generally include a hook and two laterally extending arms upon which a garment may be supported. Many hangers additionally include a pair of clamps or clips for securing or suspending a garment from the arms of the hanger.

Garment hangers having indicators which provide information, such as garment size, are well known. Preferred garment hangers have hooks provided with an upper web which prominently displays the indicator to a customer.

Many of the earlier designed indicators were easily removed from the hangers, either by inadvertent dislodgement or by slight finger prying. This created several problems. First, the indicators may be become a safety hazard if removed by young children and placed in the mouth. Second, if the indicators are inadvertently dislodged during shipping or at the place of garment display, the information which they contain is lost to the customer. Third, if the indicators are dislodged at the place of garment display, the environment thereabout becomes untidy and the floor may become slippery creating a danger.

SUMMARY OF THE INVENTION

It is therefore an object of the invention to provide a garment hanger and indicator system in which the indicator is prevented from accidental dislodgement and removal by finger prying.

It is another object of the invention to provide a garment hanger with a hook and web having which receives a locking indicator.

It is a further object of the invention to provide an indicator for a web of a hook of a garment hanger which can be manufactured easily and inexpensively.

In accord with these objects, which will be discussed in detail below, a garment hanger is provided which includes a body having a hook extending therefrom. The hook includes a web of relatively thinner material, an upper free end which receives an indicator and laterally displaced engagement means for engaging an indicator. A ridge is provided at the bottom of the web to prevent a finger purchase on the lower end of the indicator. In addition, at least lower portions of the sides of the web are also provided with ridges to prevent a finger purchase.

The indicator includes two parallel and substantially planar sides, a closed top, open ends, and an open bottom. The sides include inwardly extending mating elements which are adapted to engage with the engagement means on the web.

The web and indicator together provide an effective assembly for garment identification. Furthermore, the hook and indicator can be securely coupled together in a manner which is effectively permanent; i.e., the indicator will not release inadvertently during hanger and/or garment transport or garment display, and the indicator is not readily subject to customer removal.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
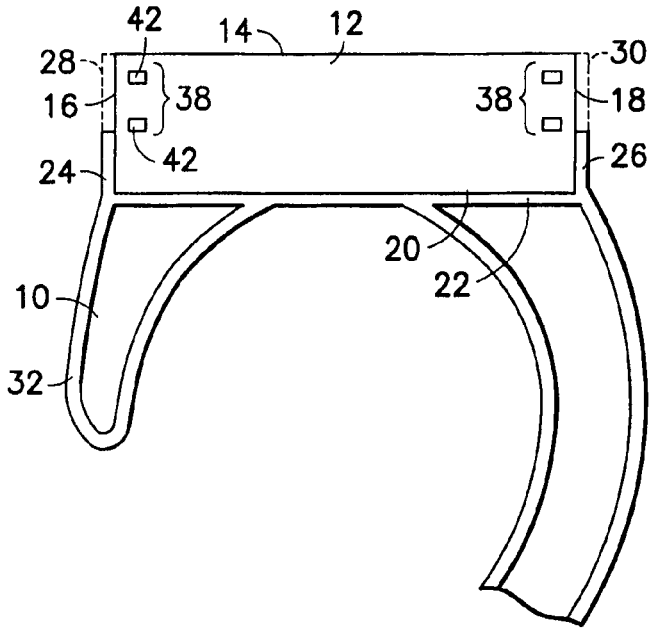
FIG. 1 is a broken section of a side elevation of a hanger showing a hook and a first embodiment of a web extending upwards from the hook.

Turning now to FIG. 1, a preferably plastic garment hanger having an upper hook 10 is shown. The hanger may include any of several means to facilitate retaining a garment relative to arms (not shown) of the hanger, such as clamps, retaining clips, ridges, grooves, channels, high friction surfaces, etc., all of which are well known in the art.

A preferably relatively thin web 12 extends upwards from the hook 10 and includes upper edge 14, lateral sides 16, 18 (which are each free edges), an attached lower edge 20, and substantially planar sides 34, 36. Alternatively, the web 12 may be the same thickness as the remainder of the hook 10. A ridge 22 is provided between the lower edge 20 of the web 12 and the hook 10. Ridges 24, 26 are also provided about lower portions of the sides of the web, and optionally about the full height of the sides 16, 18, as indicated by broken lines 28, 30. In addition, a ridge 32 may be provided about the remainder of the hook 10. The upper edge 14 of the web 12 is ridgeless.

Figure 2:
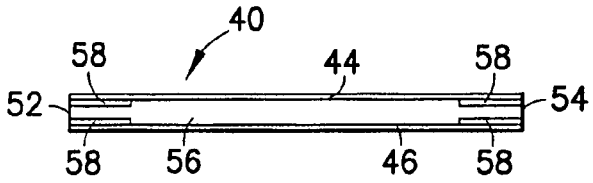
FIG. 2 is a bottom view of a first embodiment of an indicator for the web shown in FIG. 1.
Figure 3:
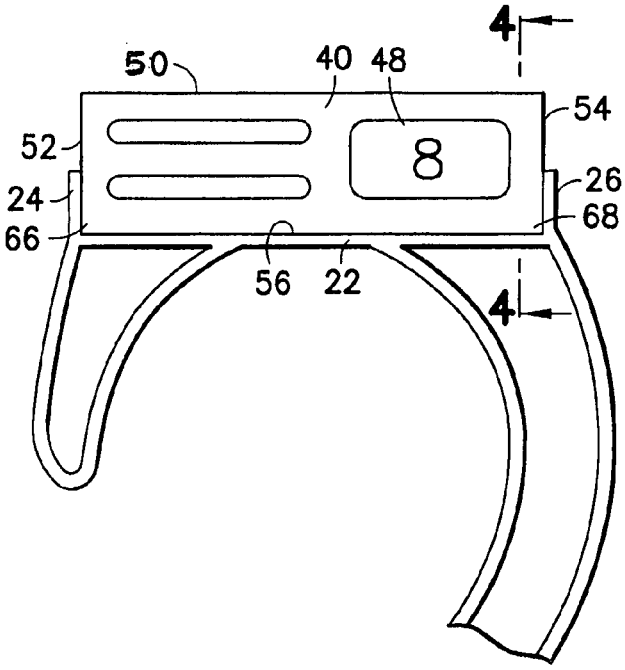
FIG. 3 is a broken section of a side elevation of a hanger, showing the indicator of FIG. 2 mounted on the web of the hanger.
Figure 4:
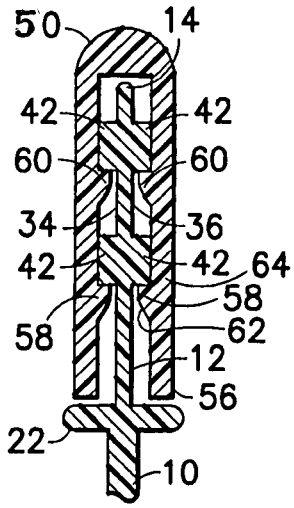
FIG. 4 is a section through line 4—4 in FIG. 3.
Figure 5:
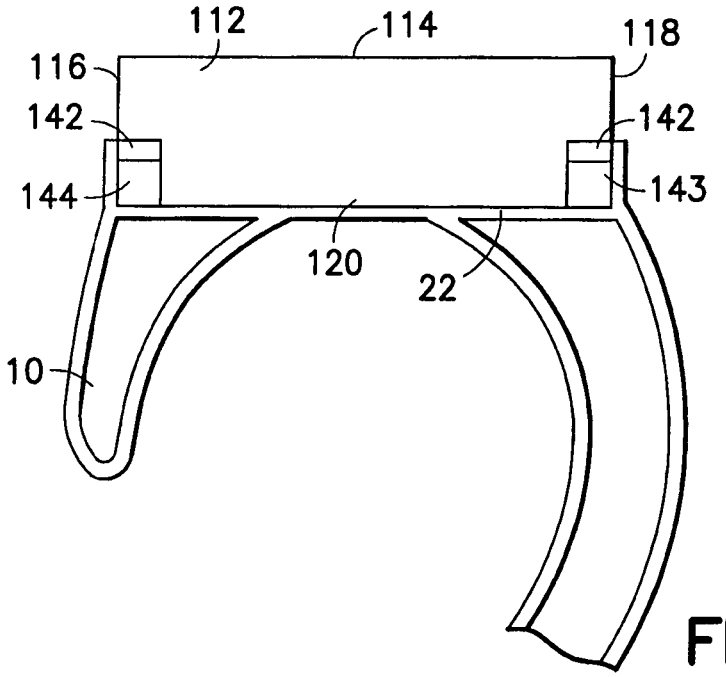
FIG. 5 is a broken section of a side elevation of a hanger showing a hook and a second embodiment of a web extending upwards from the hook.
Figure 6:
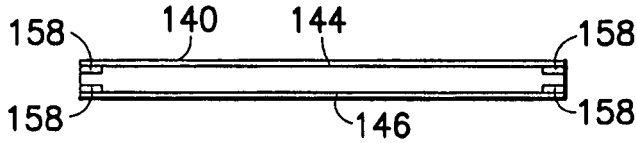
FIG. 6 is a bottom view of a second embodiment of an indicator for the web shown in FIG. 5.
Figure 7:
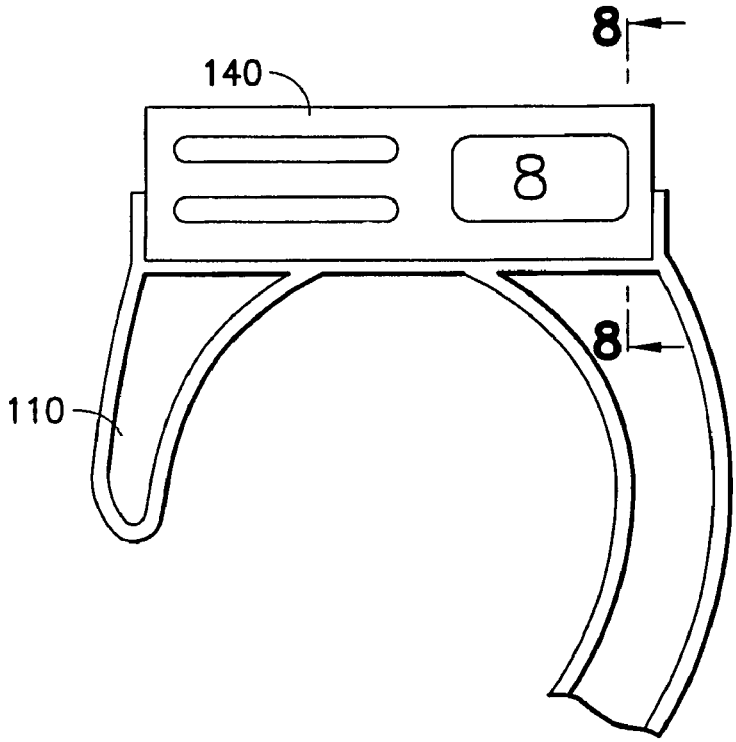
FIG. 7 is a broken section of a side elevation of a hanger, showing the indicator of FIG. 6 mounted on the web of the hanger.
Figure 8:
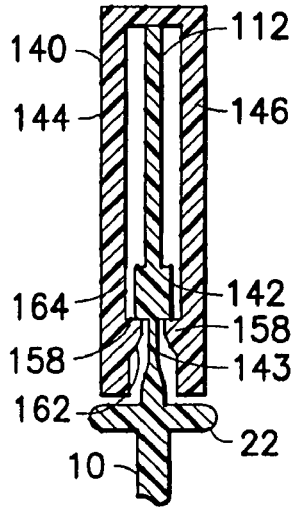
FIG. 8 is a section through line 8—8 in FIG. 7.

Referring to FIGS. 1 and 4, each of the two relatively planar sides 34, 36 of the web 12 includes laterally displaced engagement means 38 for engaging an indicator 40, described below (FIGS. 2 through 4). According to a first embodiment of the invention, each engagement means 38 includes two sets of two nubs 42 spaced between the upper and lower edges 14, 20 of the web 12. The nubs 42 are raised approximately 0.03–0.05 inch from the surface of the web 12 and are each preferably substantially square, with each side being approximately 0.05 inch in length (i.e., an upper surface area of 0.025 $in^2$). The nubs area also preferably slightly inwardly displaced from the free edges of the lateral sides 16, 18, and are separated from each other by preferably more than 0.05 inch.

Turning to FIGS. 2 through 4, the indicator 40 includes two substantially parallel and planar sides 44, 46 with indicia 48, a closed top 50, open ends 52, 54, and an open bottom 56. The sides 44, 46 include inwardly extending mating elements which are adapted to engage with the engagement means 38 on the web. Referring to FIGS. 2 and 4, in one preferred embodiment shown, the mating element at each end of each side includes a pair of catches 58, 60. Each catch, e.g., catch 58, includes a front surface or ramp 62 which is oblique (i.e., angled) relative to a surface on the nubs 42 and permits the catch 58 to be relatively easily pushed over each of the nubs (by flexing of the respective planar side of 44, 46 of the indicator 40), and a rear surface or shoulder 64 which is preferably perpendicular to the side of the indicator and substantially prevents rearward movement of the catch 58 relative to a 42 nub once passed thereover.

Referring to FIGS. 3 and 4, when the indicator 40 is pushed completely onto the web 12 (such that for each set of two lateral nubs 42 on each side 34, 36 of the web, two catches 58, 60 seat therebehind), the bottom 56 of the indicator 40 will abut the ridge 22 at the lower edge 20 of the web 12. In addition, the ridges abut lower portions 24, 26 of the sides 16, 18 of the web 12, and abut the corners 66, 68 of lower portions of the ends 52, 54 of the indicator 40. This arrangement prevents a finger purchase at the lower end of the indicator 40 for removal of the indicator, as such loosened indicators may cause a danger to children and adults. The hook 10 and indicator 40 together provide an effective assembly for garment identification, and are securely attached together.

Turning now to FIGS. 5 through 8, a second embodiment of a hook 110 and indicator 140, substantially similar to the first embodiment, is provided. The engagement means (for engaging the indicator) on the web 112 of the hook 110 in the second embodiment include at the ends of the each side of the web 112 a slightly raised and preferably laterally elongate nub 142, and a well 143 therebehind (i.e., toward the ridge 22). Each nub 142 preferably has a depth of 0.05 inch, a height of 0.015 inch, and a width of 0.12 inch. The well 143 preferably has a gradually decreasing depth, being deepest (perpendicular to the plane of the surface of the web) adjacent the nub 142 (preferably approximately 0.025 inch) and shallowest or terminating toward the ridge 22. In either of the first and second embodiments, the lateral sides 116, 118 of the web 112 may be sloped (such that the upper edge 114 is shorter than the lower edge 120) in order to facilitate placement of the indicator 140 thereon.

The indicator 140, substantially similar to indicator 40, at each end of each side includes a catch 158 having a front surface or ramp 162 which is oblique (angled) relative to the planar surface of the web 112, and permits the catch 158 to be relatively easily pushed over each of the nubs 142 (by flexing of the respective planar side of 144, 146 of the indicator 140), and a rear surface or shoulder 164 which is preferably perpendicular to the respective side of the indicator 140. When the catch 158 is pushed over the nub 142, the catch 158 resiliently drops into the well 143. Rearward movement of the indicator 140 is then substantially prevented by abutment of the rear surface 164 against the nub 142. A deeper well 143 may obviate the necessity of nub 142 in the second embodiment. Further, instead of a nub, the web may define a ramped surface which terminates at the well 143.

In accord with one object of the invention, a supply of both hangers and indicators are provided. The indicators include a plurality of indicia thereon to distinguish garments carried by the hangers, e.g., several discrete shirt sizes, dress sizes, pant sizes, bra sizes, panty sizes, etc. The hangers and indicators can be then together used as a system which is effective for garment identification. Furthermore, the hook and indicator can be securely coupled together in a manner which is substantially permanent; i.e., the indicator will not release inadvertently during hanger and/or garment transport or garment display, and the indicator is not readily subject to customer removal.

There have been described and illustrated herein embodiments of garment hanger and indicators therefor. While particular embodiments of the invention have been described, it is not intended that the invention be limited thereto, as it is intended that the invention be as broad in scope as the art will allow and that the specification be read likewise. Thus, while particular laterally displaced engagement means on the web on top of the hanger have been disclosed, it will be appreciated that other suitable laterally displaced engagement means can be used as well. For example, the square nubs could be rectangular, circular or oval. Also, the nubs and wells can be of different dimensions than the preferred dimensions described, provided such dimensions enable suitable substantially permanent engagement between the web and indicator. Furthermore, while the hanger is preferably made of plastic, it may be made of other suitable materials, such as metal or wood. It will therefore be appreciated by those skilled in the art that yet other modifications could be made to the invention without deviating from its spirit and scope as claimed.

What is claimed is:

1. A garment hanger for receiving an indicator thereon, comprising:

a) a hanger body including a hook;

b) a web extending upwards from said hook, said web having a lower edge attached to said hook, two free lateral edges, a free upper edge, and two substantially planar sides extending between said lower, lateral and upper edges, each of said substantially planar sides having immovable laterally displaced engagement means for receiving mating elements of the indicator to secure the indicator thereon and prevent removal of the indicator by vertical movement of the indicator off of the web; and c) a ridge provided between said web and said hook.

2. A garment hanger according to claim 1, wherein:

at least a portion of each of said lateral edges is provided with a ridge.

3. A garment hanger according to claim 1, wherein:

each of said laterally displaced engagement means is located adjacent said lateral edges of said web.

4. A garment hanger according to claim 1, wherein:

each of said laterally displaced engagement means includes two nubs spaced between said upper and lower edges of said web.

5. A garment hanger according to claim 4, wherein:

said nubs are raised approximately 0.03–0.05 inch in height from a surface of said web.

6. A garment hanger according to claim 4, wherein:

said nubs have an upper surface area of approximately 0.025 $in^2$.

7. A garment hanger according to claim 1, wherein:

each of said laterally displaced engagement means includes a nub, and a well located between said nub and said lower edge of said web.

8. A garment hanger according to claim 7, wherein:

said well has a gradually decreasing depth.

9. A garment hanger according to claim 1, wherein:

said upper edge and said lower edge are straight and parallel, and said lateral edges are sloped such that said upper edge is shorter than said lower edge.

10. A garment hanger assembly, comprising:

a) a garment hanger including a body having a hook, a web extending upwards from said hook, said web having a lower edge attached to said hook, two free lateral edges, a free upper edge, and two substantially planar sides extending between said lower, lateral and upper edges, and a ridge provided between said web and said hook;

b) an indicator including first and second displaced sidewalls, a closed top, an open bottom, open lateral sides, and indicia on at least one of said sidewalls; and c) engagement means for coupling an indicator to said web of said hanger, said means disposed adjacent each of said two lateral edges while a central portion of said web remains unengaged relative to said indicator, wherein when said indicator is seated on said web of said hanger such that said engagement means are operable, said ridge substantially prevents finger purchase on said open bottom of said indicator thereby restricting removal of said indicator from said hanger.

11. A garment hanger assembly according to claim 10, wherein:

said engagement means includes, on each substantially planar side of said web, two nubs adjacent each of said lateral edges spaced between said upper and lower edges of said web.

12. A garment hanger assembly according to claim 11, wherein:

said nubs are raised approximately 0.03–0.05 inch in height from a surface of said web.

13. A garment hanger assembly according to claim 11, wherein:

said nubs have an upper surface area of approximately 0.025 $in^2$.

14. A garment hanger assembly according to claim 11, wherein:

said engagement means further includes a plurality of catches on each said indicator, said catches being located adjacent to each lateral edge when the indicator is received on the web, said catch including a ramp which contacts a nub when said open bottom of said indicator is pushed over the web and a shoulder which prevents rearward movement relative to the nub once the catch is advanced passed the nub.

15. A garment hanger assembly according to claim 11, wherein:

said engagement means includes, on each substantially planar side of said web, wells located at corners defined in said web adjacent said lower edge and said lateral edges.

16. A garment hanger assembly according to claim 15, wherein:

said engagement means further includes, on each substantially planar side of said web, a nub located adjacent a wall of said well facing said upper edge of said web.

17. A garment hanger assembly according to claim 15, wherein:

said well has a gradually decreasing depth.

18. A garment hanger assembly according to claim 15, wherein:

said engagement means further includes a plurality of catches on each said indicator, said catches being located adjacent to each lateral edge when the indicator is received on the web, each said catch being received in a respective said well when the indicator fully seated on the web.

19. A garment hanger assembly according to claim 10, wherein:

said upper edge and said lower edge of said web are straight and parallel, and said lateral edges are sloped such that said upper edge is shorter than said lower edge.

20. A garment hanger assembly according to claim 10, wherein:

said indicator has open lateral ends.

21. A garment hanger assembly according to claim 20, wherein:

said indicator has planar side walls which are substantially parallel.

22. A garment hanger assembly according to claim 10, wherein:

said first and second displaced sidewalls of said indicator are substantially parallel and include bottom ends which are substantially parallel and laterally spaced from said web.

23. A garment hanger system, comprising:

a) a supply of garment hangers, each including a hanger body having, i) a hook, ii) a web extending upwards from said hook, said web having a lower edge attached to said hook, two free lateral edges, a free upper edge, and two substantially planar sides extending between said lower, lateral and upper edges, and iii) a ridge provided between said web and said hook;

b) a supply of indicators, said indicators including first and second displaced sidewalls, a closed top, an open bottom, open lateral sides, and indicia on at least one of said sidewalls, said supply including a plurality of sets of indicators wherein each set includes a discrete indicia relative to the other sets; and c) engagement means for coupling an indicator to said web of a respective one of said hangers, said means disposed adjacent each of said two lateral edges while a central portion of said web remains unengaged relative to said indicator, wherein when a respective said indicator is seated on said web of a respective said hanger such that said engagement means are operable, said ridge substantially prevents finger purchase on said open bottom of said indicator thereby restricting removal of said indicator from said hanger.

* * * * *